US005732486A

United States Patent [19]

Rapisarda

[11] Patent Number: 5,732,486

[45] Date of Patent: Mar. 31, 1998

[54] FOOTWEAR WITH LIGHT EMITTING DIODES

[76] Inventor: Carmen Rapisarda, 1715 Edgecomb, Covina, Calif. 91724

[21] Appl. No.: 105,465

[22] Filed: Aug. 9, 1993

Related U.S. Application Data

[63] Continuation of Ser. No. 806,925, Dec. 11, 1991, abandoned.

[51] Int. Cl.[6] ..... A43B 23/00

[52] U.S. Cl. ..... 36/137; 36/136; 362/103

[58] Field of Search ..... 36/132, 136, 137, 36/139; 362/103

[56] References Cited

U.S. PATENT DOCUMENTS

| | | | |
|---|---|---|---|
| 1,597,823 | 8/1926 | Randolph | 36/137 |
| 3,008,038 | 11/1961 | Dickens et al. | 36/137 |
| 3,800,133 | 3/1974 | Duval | 240/6.4 W |
| 4,014,115 | 3/1977 | Reichert | 36/137 |
| 4,128,861 | 12/1978 | Pelengaris | 36/137 |
| 4,130,951 | 12/1978 | Powell | 36/137 |
| 5,033,212 | 7/1991 | Evanyk | 36/137 |
| 5,052,131 | 10/1991 | Rondini | 36/137 |
| 5,235,761 | 8/1993 | Chang | 36/137 |
| 5,285,586 | 2/1994 | Goldston et al. | 36/137 |

FOREIGN PATENT DOCUMENTS

| | | | |
|---|---|---|---|
| 0121026 | 10/1984 | European Pat. Off. | 36/137 |
| 0335467 | 10/1989 | European Pat. Off. | 36/137 |
| 2608485 | 9/1977 | Germany | 36/137 |
| 2838770 | 3/1980 | Germany | 36/137 |
| 3343897 | 6/1985 | Germany | 36/137 |
| 2556190 | 10/1985 | Germany | 36/136 |
| 3824352 | 2/1990 | Germany | 36/132 |

*Primary Examiner*—Ted Kavanaugh
*Attorney, Agent, or Firm*—Edgar W. Averill, Jr.

[57] ABSTRACT

An improved shoe have a light-emitting diode and a batter contained therein. The light-emitting diode is turned on when the wearer of the shoe exerts pressure on the heel of the shoe as in walking or running. Preferably, the light-emitting diode is at the back of the heel, and more than one light-emitting diode may be used.

11 Claims, 5 Drawing Sheets

16
28
15
20
21
17
10
13
11
14
12
22
26
23
19
24
18
25
2
27

FOOTWEAR WITH LIGHT EMITTING DIODES

This is a continuation of application (s) Ser. No. 07/806,925 filed on Dec. 11, 1991 now abandoned.

BACKGROUND OF THE INVENTION

The field of the invention is footwear, and the invention relates more particularly to footwear with molded soles of the type generally referred to as a "gym shoe."

Gym shoes, or more specifically basketball shoes and tennis shoes, have become a large selling product particularly to the youth. Various innovations have been devised to attract customers for such shoes such as an air pump. Since many such shoes are worn at night, ways are needed to improve visibility for safety.

SUMMARY OF THE INVENTION

It is an object of the present invention to provide a gym shoe which has the ability to emit light and, preferably, the ability to emit light on an intermittent basis during walking.

The present invention is for an improved shoe having a rubber, or plastic, sole. At least one light-emitting diode is imbedded in the sole so that the light-emitting portion of the diode is visible from the exterior of the shoe. A battery and a switch are also held by the shoe and, preferably, imbedded in the sole thereof. In a preferred configuration, the light-emitting diode is energized by a wafer battery which is contacted by a biased conductor during walking.

DESCRIPTION OF THE PREFERRED EMBODIMENTS

Figures 1, 2, 3:
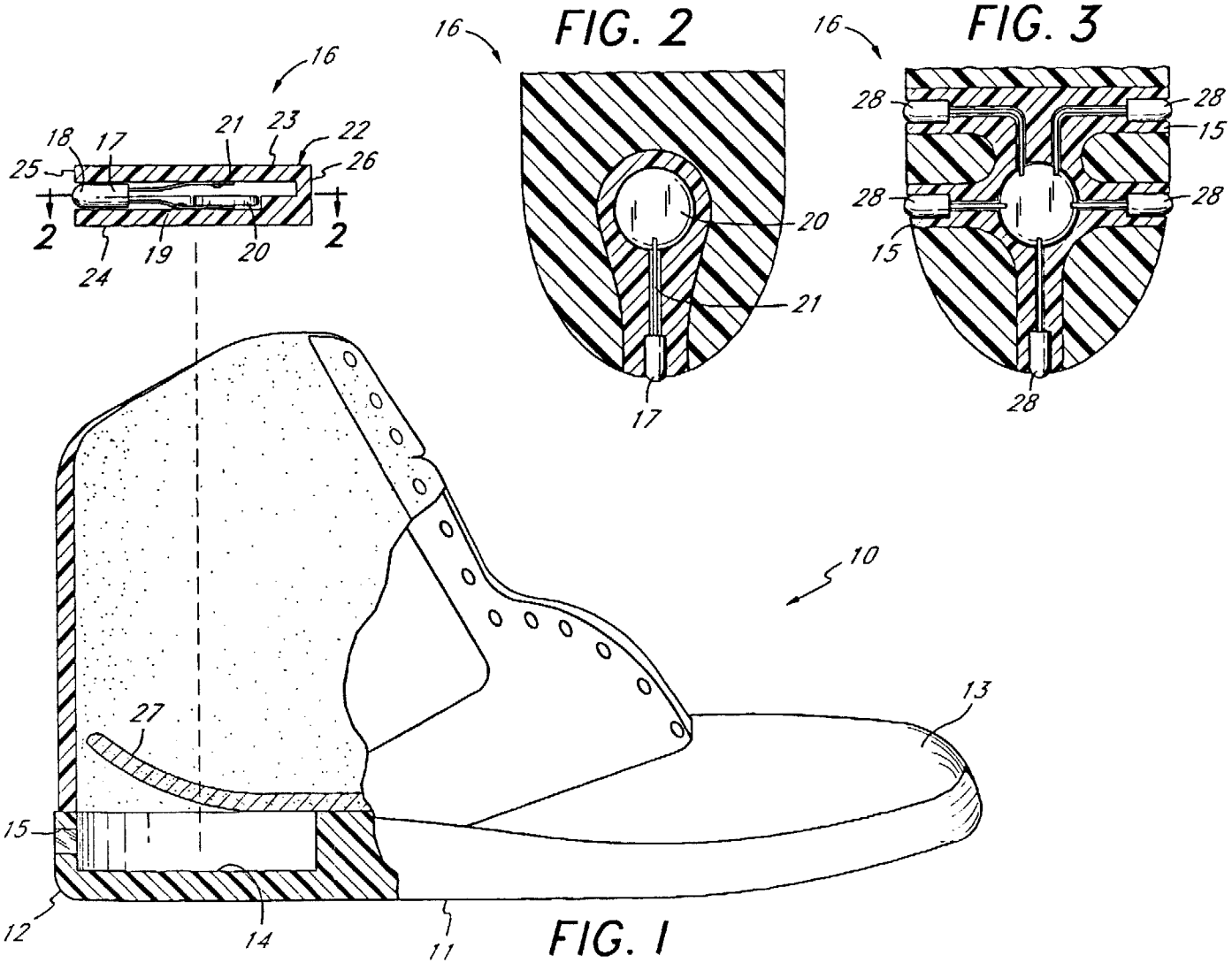
FIG. 1 is a side view partially in cross-section of the improved gym shoe of the present invention showing a light-emitting diode and battery assembly in exploded view.
FIG. 2 is a cross-sectional view taken along line 2—2 of FIG. 1.
FIG. 3 is an alternate embodiment of the configuration of FIG. 2.

A shoe containing a light-emitting diode and battery package is shown in side view in FIG. 1 and indicated generally by reference character 10. Shoe 10 has a sole 11, a heel 12 and a toe 13. A recess 14 is formed in heel 12, and a window 15 passes through the end of heel 12 from the recess to the exterior thereof.

A light-emitting diode, battery and switch assembly is shown above shoe 10 and indicated by reference character 16. Assembly 16 includes a light-emitting diode 17 having a light-emitting portion 18. LED 17 has a first conductor 19 which passes under and is in electrical contact with one of the terminals of wafer battery 20. The second conductor 21 is biased above the upper surface of wafer battery 20, and the entire assembly is formed in a box 22 having a top 23, a bottom 24, a front edge 25 and a rear edge 26.

Assembly 16 is dropped into recess 14 by lifting pad 27. The light-emitting portion of LED 17 is adjacent window 15. When pressure is placed on the top 23 of box 22, the second conductor 21 contacts the top of wafer battery 20 completing the circuit and energizing the LED. Thus, during walking, when the heel is stepped on, the LED will turn on, and after the heel has been lifted, the LED turns off. Thus, in walking or running, the LED flashes on and off providing a highly visible light which provides additional safety as well as attractiveness. Assembly 16 is shown in cross-sectional view in FIG. 2 where the lower conductor 19 is also shown. Battery 20 is preferably a lithium battery of the type commonly used in watches and computers which has a long life and excellent durability. Such batteries have one pole on one surface and the other pole along the sides and bottom. Thus, by supporting conductor 21 above battery 20, the circuit is completed when the conductor 21 is moved downwardly onto the top of battery 20.

As shown in FIG. 3, the LED, battery and switch assembly 16 may have more than one LED, and five LEDs 28 are shown in FIG. 3. While the window portion 15 is shown as a transparent member, it need only be a light-transmitting area and may be hollow, transparent or translucent. It may also contain an opaque portion with the manufacturer's logo or the like.

Figure 4:
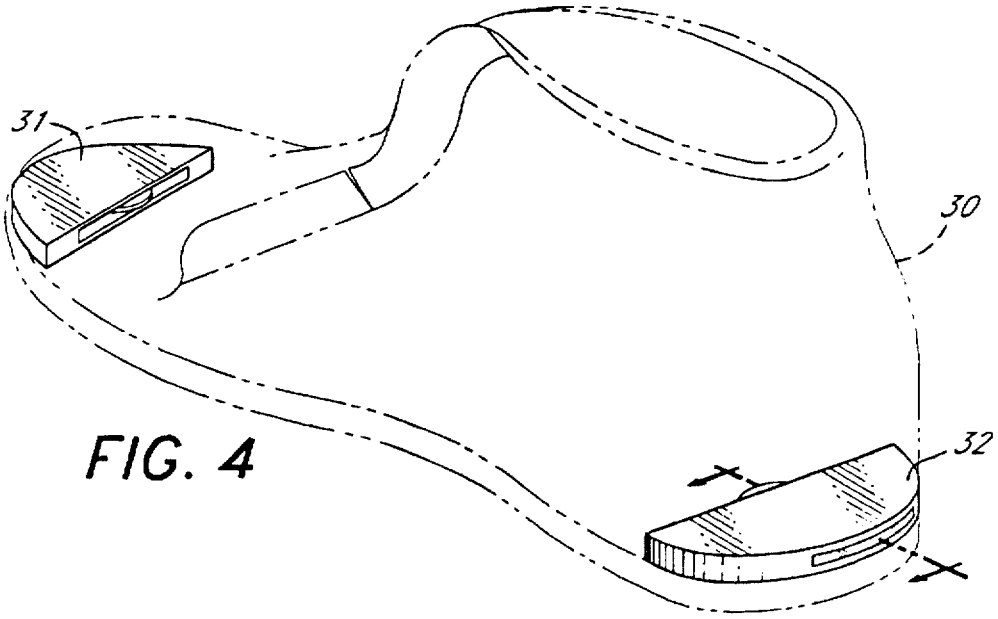
FIG. 4 is a perspective view of a shoe in phantom view having a pair of light-emitting diodes and battery pack imbedded therein.
Figure 5:
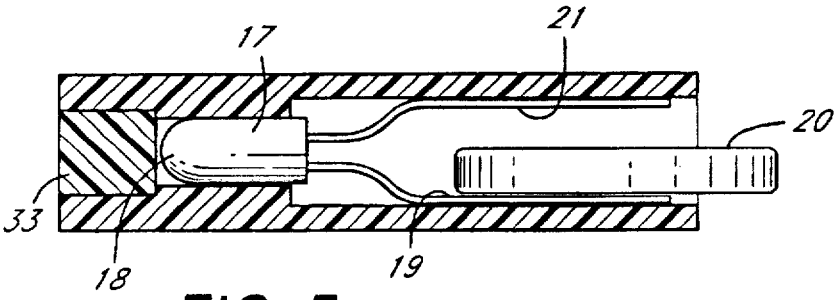
FIG. 5 is an enlarged cross-sectional view taken along line 5—5 of FIG. 4.
Figure 6:
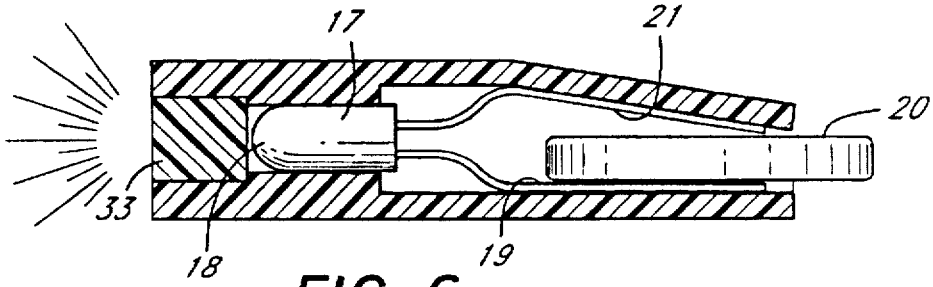
FIG. 6 is a cross-sectional view analogous to FIG. 5 except the switch thereof is closed.

An alternate configuration of shoe is shown in perspective view in FIG. 4 where the shoe 30 is shown in phantom view, and a pair of LED, battery and switch assemblies 31 and 32 are shown in the toe and heel, respectively. The battery assembly 32 is shown in cross-sectional view in FIG. 5 and can also be seen to have a wafer battery 20, an LED 17 with a light-emitting portion 18, a first conductor 19 and a second conductor 21. In this configuration, the window 33 is formed in the assembly 32, and this assembly is added or removed from the exterior of the shoe.

Figure 7:
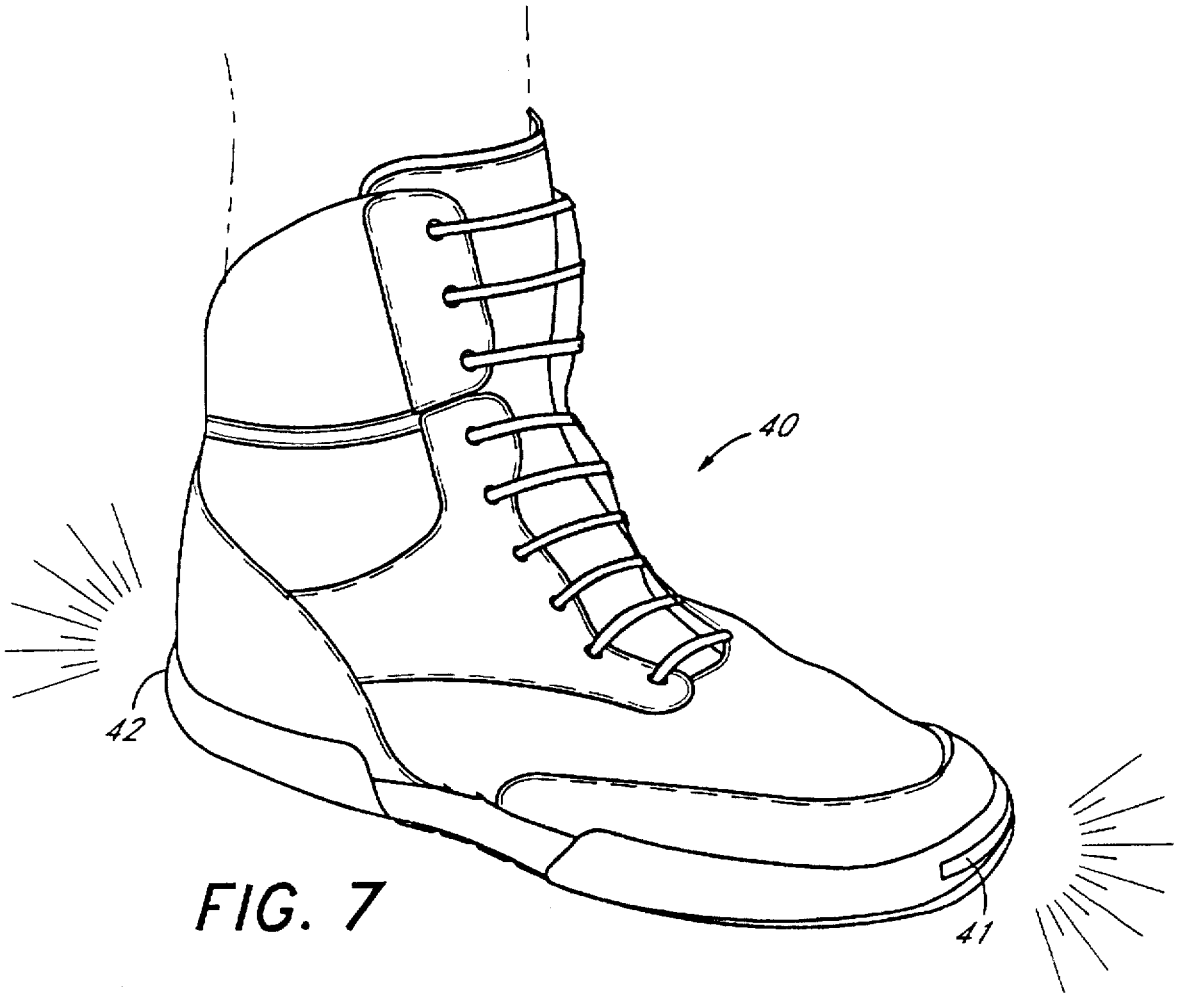
FIG. 7 is a perspective view of the gym shoe of the present invention having a light-emitting diode at the heel and at the toe.
Figure 8:
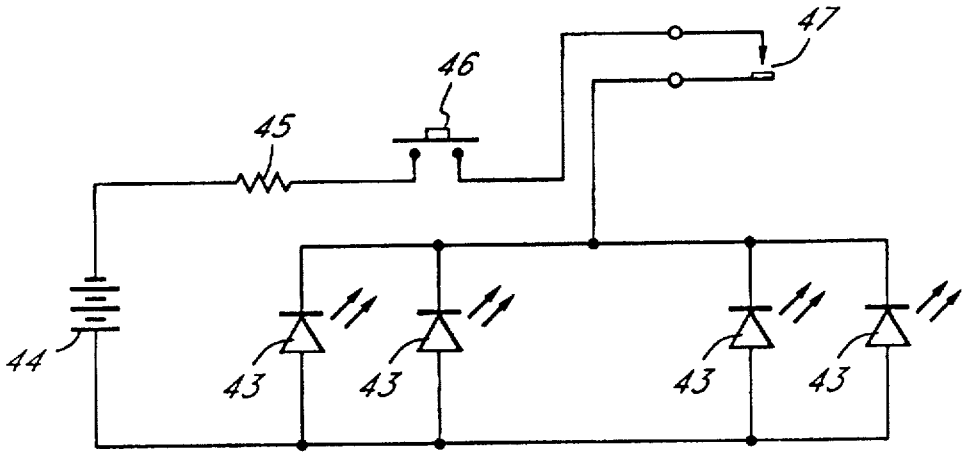
FIG. 8 is a circuit diagram of the circuit of the shoe of FIG. 7.
Figures 9, 10:
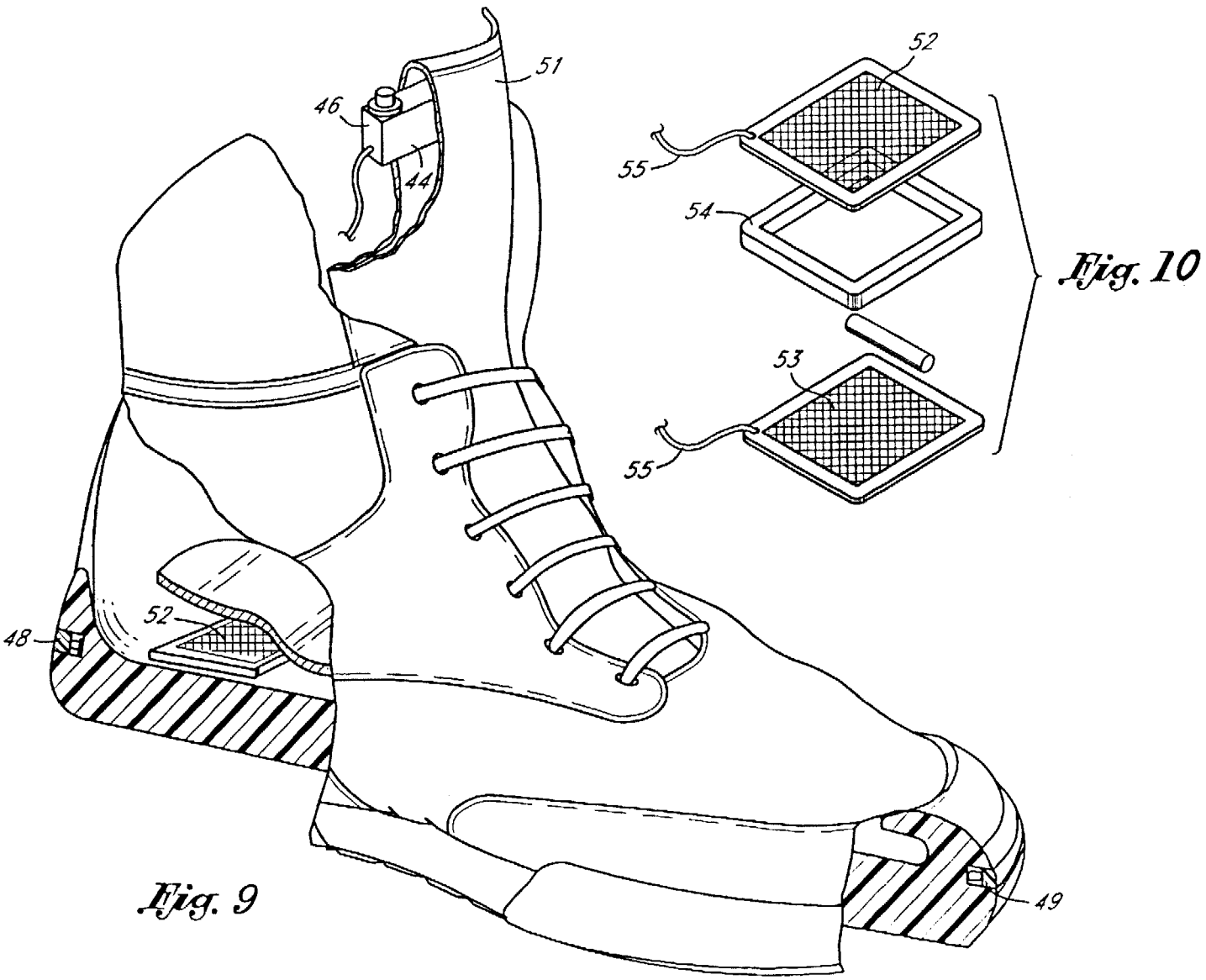
FIG. 9 is a perspective view of an alternate embodiment of a shoe partially cut away and having a light-emitting diode in the heel and toe and a switch in the tongue.
FIG. 10 is an exploded perspective view of the switch of the shoe of FIG. 9.

A shoe is shown in perspective view in FIG. 7 and indicated by reference character 40 having a transparent window 41 at the toe and a transparent window 42 at the heel. The circuit of this assembly is shown in FIG. 8 where light-emitting diodes 43 are connected in parallel with a battery 44, a resistor 45, an on/off switch 46 and a pressure sensitive switch 47. The shoe 40 is shown in a cutaway view in FIG. 9 where it can be seen that the LEDs 43 are mounted behind transparent windows 48 and 49 and, in this instance, an on/off switch 46 is located in the tongue 51 of shoe 40. A pressure sensitive switch comprising a pair of copper screens 52 and 53 separated by a frame member 54 is placed in the heel as shown in FIG. 9. Conductors 55 are connected by pressure from the wearer's heel on screen 52 which completes a circuit with screen 53 lighting the LEDs when switch 46 is closed. The battery 44 is contained in the box in which switch 46 is supported. The battery 44 is contained in the box in which switch 46 is supported.

Figure 11:
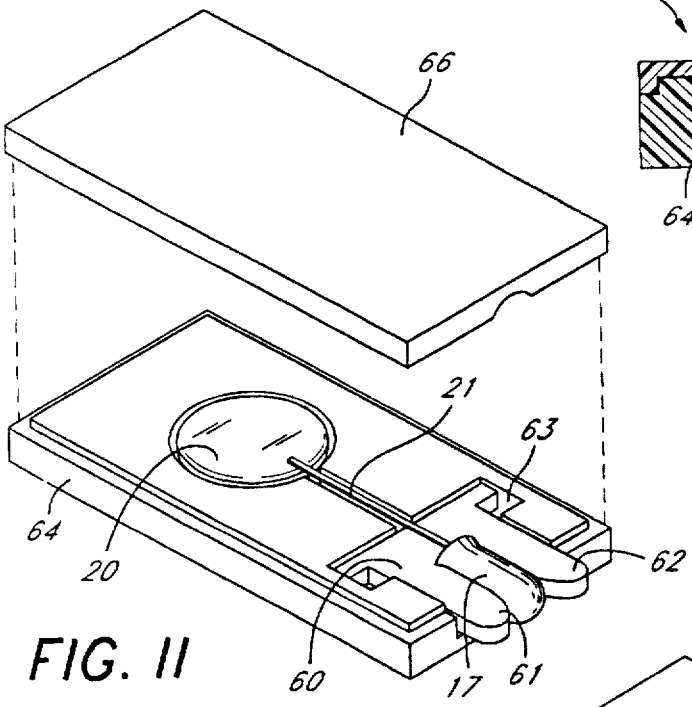
FIG. 11 is an exploded perspective view of an alternate embodiment of a light-emitting diode and battery assembly including means to deactivate the light-emitting diode.
Figure 13:
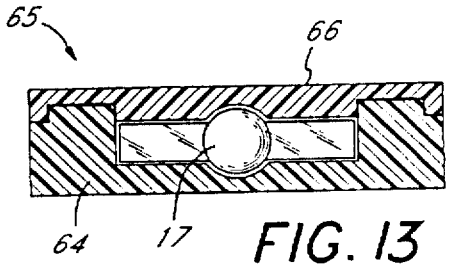
FIG. 13 is a cross-sectional view taken along line 13—13 of FIG. 12.
Figure 12:
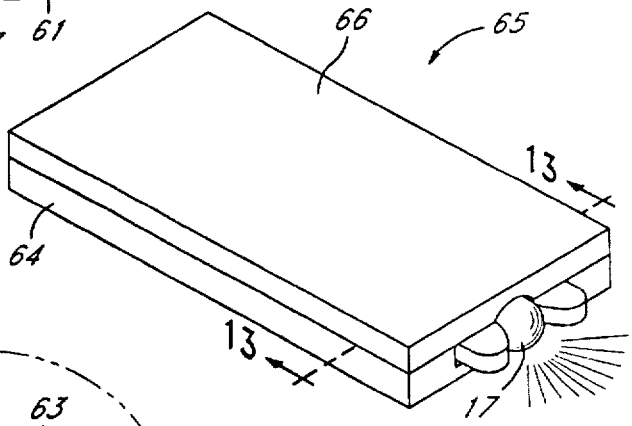
FIG. 12 is a perspective view of the assembly of FIG. 11.
Figure 14:
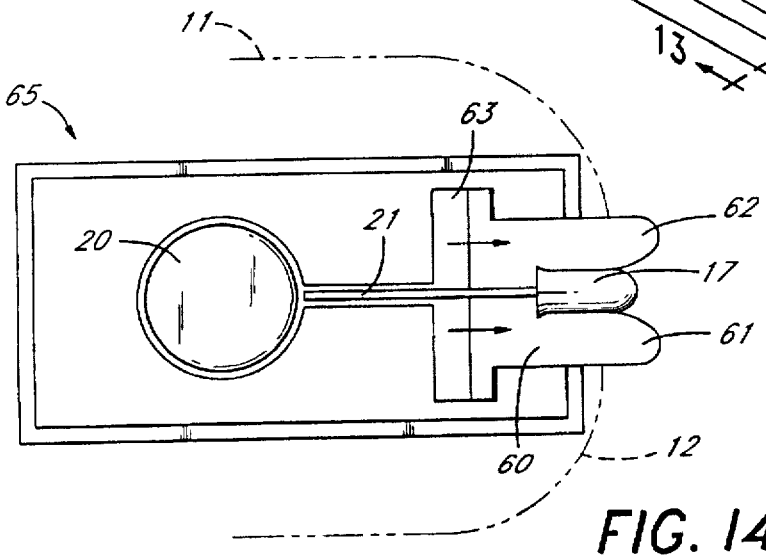
FIG. 14 is a plan view of the lower portion of the assembly of FIG. 11 showing the assembly in a deactivated position.

An alternate embodiment of a battery and LED assembly is shown in FIGS. 11, 12, 13 and 14. In these figures, the assembly permits the LED to be deactivated when it is not desired to have it turn on and off during walking. The LED 17 is slideably held on movable block 60 which has a pair of extensions 61 and 62 which protrude past the heel 12 shown in phantom view in FIG. 14. MoVable block 60 is held in a recess 63 molded into the bottom 64 of box 65. It can be seen by comparing FIGS. 11 and 14 that movable block 60 may be in a rearward position, as shown in FIG. 11, or an extended position as shown in FIG. 14. When in its rearward position, as shown in FIG. 11, second conductor 21 is positioned over wafer battery 20, and the first conductor (not shown) is positioned below the battery 20 similar to the view shown in FIG. 1. The second conductor 21 is supported above battery 20 and out of contact therewith unless pressure is placed on the top 66 of box 65 by the wearer's heel. Box 65 is fabricated from a slightly flexible material such as rubber. The assembly is activated by pushing in on extensions 61 and 62 to place the conductors in a position where they will be moved into contact with battery 20 when heel pressure is applied. However, when the extensions 61 and 62 are pulled outwardly to the position shown in FIG. 14, no amount of pressure will cause conductor 21 to contact battery 20 and, thus, the device will be inactivated. The box is shown in cross-sectional view in FIG. 13 where it can be seen that top 66 fits closely over the bottom 64 of box 65.

It has been found that by using a slightly translucent material for the windows, that a particularly dramatic effect is obtained. Because the LED is off when the shoes are not being worn and for a substantial amount of time when the shoes are being worn, it has been found that the battery has an especially long life.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved shoe of the type having a flexible sole and having a heel and a toe and having at least one light-emitting diode in the sole thereof, said light emitting diode having a light emitting portion, a first conductor and a second conductor, said at least one light emitting diode being supported in the sole of the shoe so that the light-emitting portion thereof is visible from the exterior of the shoe, at least one wafer battery having a first surface and a second surface and a positive terminal on one surface and a negative terminal on the other surface, said at least one wafer battery being held by said shoe and electrically connectable to said first conductor and said second conductor of said at least one light-emitting diode when weight is exerted on the sole of said shoe, wherein the improvement comprises:

supporting said light emitting portion of said at least one light emitting diode so that the first conductor thereof extends in a cantilevered manner from said light emitting portion and is a cantilevered conductor and said cantilevered conductor is adjacent but not touching one of the terminals of said at least one wafer battery so that when weight is exerted over the cantilevered conductor by walking, the cantilevered conductor is moved downwardly into contact with said one of said terminals of said at least one wafer battery; and means for electrically connecting the second conductor to the other of said terminals of said wafer battery so that the circuit between the light emitting diode and the wafer battery is completed and the light emitting diode is energized when weight is being exerted over the cantilevered conductor and when the weight is removed over the cantilevered conductor, the natural elasticity of the cantilevered conductor will cause it to move out of contact with said terminal of said wafer battery thereby de-energizing the light emitting diode.

2. The improved gym shoe of claim 1 wherein said at least one light emitting diode is located in the heel of said shoe.

3. The improved gym shoe of claim 1 wherein said at least one wafer battery is located in the heel of said shoe.

4. The improved gym shoe of claim 3 wherein a plurality of light emitting diodes is located in the heel of said shoe.

5. An improved gym shoe of the type having a molded, flexible sole including a toe and a heel, a light emitting diode having a light emitting portion held by said sole, said light emitting diode having a first and a second conductor, and a wafer battery also supported in said flexible sole, wherein the improvement comprises:

a light-transmitting window formed in the sole of the shoe and visible from the heel thereof; and a light-emitting diode positioned so that said first and second conductors are oriented to provide an upper conductor and a lower conductor, said light-emitting diode being held in an enclosure together with said wafer battery, said wafer battery being positioned horizontally having an upper and lower terminal, one of said upper and lower terminals being a positive terminal and the other of said upper and lower terminals being a negative terminal and said first conductor being a cantilevered conductor supported in a cantilevered manner by said light emitting portion so that it does not touch either the upper or lower terminals of said wafer battery when no weight is exerted over said enclosure and said second conductor being in continuous electrical contact with the lower terminal, said enclosure being supported in a cavity formed in the sole of said shoe adjacent the light-transmitting window and positioned so that the light-emitting portion is adjacent to said light-transmitting window and wherein the weight of the wearer's heel during walking elastically moves the first conductor downwardly into contact with the upper terminal of said wafer battery and turns the light-emitting diode on and the removal of the weight allows the first conductor to move away from the upper terminal of the battery and turns the light-emitting diode off.

6. The improved gym shoe of claim 5 wherein the lower conductor of said light emitting diode is supported in physical contact with the lower terminal of said wafer battery.

7. The improved gym shoe of claim 5 wherein there are a plurality of light emitting diodes.

8. The improved gym shoe of claim 5 wherein said light transmitting window is a hollow opening.

9. The improved gym shoe of claim 5 wherein said light transmitting window is a translucent window.

10. The improved gym shoe of claim 5 further including switch means for removing said cantilevered conductor from contact with said wafer battery even when pressure is exerted over said battery.

11. The improved gym shoe of claim 10 wherein said switch means for removing said cantilevered conductor from contact with said wafer battery comprises moving said light-emitting diode away from said battery.

* * * * *